US007896985B2

(12) United States Patent
Arai et al.

(10) Patent No.: US 7,896,985 B2
(45) Date of Patent: Mar. 1, 2011

(54) SEAMLESS STEEL PIPE FOR LINE PIPE AND A PROCESS FOR ITS MANUFACTURE

(75) Inventors: Yuji Arai, Amagasaki (JP); Kunio Kondo, Sanda (JP); Nobuyuki Hisamune, Kinokawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 27 days.

(21) Appl. No.: 12/071,493

(22) Filed: Feb. 21, 2008

(65) Prior Publication Data

US 2009/0114318 A1 May 7, 2009

Related U.S. Application Data

(63) Continuation of application No. PCT/JP2006/316399, filed on Aug. 22, 2006.

(30) Foreign Application Priority Data

Aug. 22, 2005 (JP) ..... 2005-240069

(51) Int. Cl.
*C21D 9/08* (2006.01)
*C22C 38/44* (2006.01)

(52) U.S. Cl. ..... 148/593; 148/335

(58) Field of Classification Search ..... 148/335, 148/593

See application file for complete search history.

(56) References Cited

U.S. PATENT DOCUMENTS 6,245,290 B1 6/2001 Koo et al.

FOREIGN PATENT DOCUMENTS

| | | |
|---|---|---|
| EP | 1 025 272 | 6/2006 |
| EP | 1 876 254 | 1/2008 |
| JP | 09-041074 | 2/1997 |
| JP | 09-235617 | 9/1997 |
| JP | 11-036042 | 2/1999 |
| JP | 2000-169913 | 6/2000 |
| JP | 2001-288532 | 10/2001 |

*Primary Examiner*—Jessica L Ward
*Assistant Examiner*—Alexander Polyansky
(74) *Attorney, Agent, or Firm*—Clark & Brody

(57) ABSTRACT

A seamless steel pipe for line pipe having a high strength and good toughness and corrosion resistance even though having a thick wall has a chemical composition comprising, in mass percent, C: 0.02-0.08%, Si: at most 0.5%, Mn: 1.5-3.0%, Al: 0.001-0.10%, Mo: greater than 0.4% to 1.2%, N: 0.002-0.015%, Ca: 0.0002-0.007%, and a remainder of Fe and impurities, wherein the contents of the impurities are at most 0.03% for P, at most 0.005% for S, at most 0.005% for O and less than 0.0005% for B and wherein the value of Pcm calculated by the following Equation (1) is at least 0.185 and at most 0.250. The steel pipe has a microstructure which primarily comprises bainite and which has a length of cementite of at most 20 micrometers:

$$Pcm=[C]+[Si]/30+([Mn]+[Cr]+[Cu])/20+[Mo]/15+[V]/10+5[B] \quad (1)$$

wherein [C], [Si], [Mn], [Cr], [Cu], [Mo], [V] and [B] are numbers respectively indicating the content in mass percent of C, Si, Mn, Cr, Cu, Mo, V and B.

6 Claims, 3 Drawing Sheets

SEAMLESS STEEL PIPE FOR LINE PIPE AND A PROCESS FOR ITS MANUFACTURE

This application is a continuation of International Patent Application No. PCT/JP2006/316399, filed Aug. 22, 2006. This PCT application was not in English as published under PCT Article 21(2).

TECHNICAL FIELD

This invention relates to a seamless steel pipe for line pipe having excellent strength, toughness, corrosion resistance, and weldability and to a process for manufacturing the same. A seamless steel pipe according to the present invention is a high-strength, high-toughness, thick-walled seamless steel pipe for line pipe having a strength of at least X80 grade (a yield strength of at least 551 MPa) prescribed by API (American Petroleum Institute) specifications as well as good toughness and corrosion resistance. It is particularly suitable for use as sea bottom flow lines or risers.

BACKGROUND ART

In recent years, oil and natural gas resources located on land or in so-called shallow seas having a water depth of up to approximately 500 meters have been drying up, so sea bottom oil fields in so-called deep seas at 1000-3000 meters below the ocean surface, for example, are being actively developed. With deep sea oil fields, it is necessary to transport crude oil or natural gas from the wellhead of an oil well or natural gas well located on the sea bottom to a platform on the surface of the sea using steel pipes referred to as flow lines and risers.

A high internal fluid pressure due to the pressure of deep underground layers is applied to the interior of steel pipes constituting flow lines installed in deep seas. In addition, when operation is stopped, they are subjected to the water pressure of deep seas. Steel pipes constituting risers are also subjected to repeated strains due to waves.

Flow lines used herein are steel pipes for transport which are installed along the contours on the ground or the sea bottom, and risers are steel pipes for transport which rise from the surface of the sea bottom to platforms on the surface of the sea. When such pipes are used in deep sea oil fields, it is considered necessary for their thickness to normally be at least 30 mm, and in actual practice, it is customary to use thick-walled pipes having a thickness of 40-50 mm. It can be seen from this fact that these materials are used in severe conditions.

FIG. 1 is an explanatory view schematically showing an example of an arrangement of risers and flow lines in the sea. In this figure, a wellhead 12 provided on the sea bottom 10 and a platform 14 provided on the water surface 13 immediately above it are connected by a top tension riser 16. A flow line 18 installed on the sea bottom extends from an unillustrated remote wellhead to the vicinity of the platform 14. The end portion of this flow line 18 is connected to the platform 14 by a steel catenary riser 20 which extends upwards in the vicinity of the platform.

The environment of use of the illustrated risers and flow line is severe, and is said to reach a temperature of 177° C. and an internal pressure of 1400 atmospheres. Accordingly, steel pipes used for risers and flow lines must be able to withstand such a severe environment of use. Moreover, a riser is subjected to bending stress due to waves, so it must also be able to withstand such external influences.

Accordingly, steel pipes having a high strength and high toughness are desired for risers and flow lines. In addition, in order to ensure high reliability, seamless steel pipes are used instead of welded steel pipes. For welded steel pipes, techniques for manufacturing steel pipes having a strength exceeding X80 grade have already been disclosed. For example, Patent Document 1 (JP H09-41074 A1) discloses a steel which exceeds X100 grade (a yield strength of at least 689 MPa) specified in API standards. A welded steel pipe is formed by first manufacturing a steel plate, forming the steel plate into a tubular shape, and welding it to form a steel pipe. In order to impart important properties such as strength and toughness when manufacturing a steel plate, the microstructure is controlled by applying thermomechanical heat treatment to the steel plate during rolling thereof. Patent Document 1 also carries out thermomechanical heat treatment, when a steel plate is being hot rolled, such that its microstructure is controlled so as to contain strain-induced ferrite, thereby achieve the properties of the steel pipe after welding. Accordingly, the technique disclosed in Patent Document 1 can only be realized by a rolling process for a steel plate to which thermomechanical heat treatment can easily be applied by controlled rolling. Therefore, this technique can be applied to a welded steel pipe but not to a seamless steel pipe.

As long as seamless steel pipes are concerned, in recent years, seamless steel pipes of X80 grade have been developed. It is difficult to apply to seamless steel pipes the above-described technique utilizing thermomechanical heat treatment which was developed for welded steel pipes, so basically it is necessary to obtain desired properties by heat treatment after pipe formation. A technique for manufacturing a seamless steel pipe of X80 grade (a yield strength of at least 551 MPa) is disclosed in Patent Document 2 (JP 2001-288532 A1), for example. However, as disclosed in the examples of Patent Document 2, the technique in that document is validated only with a thin-walled seamless steel pipe (wall thickness of 11.1 mm) which essentially has good hardenability by quenching. Therefore, even if the technique disclosed therein is employed, when manufacturing a thick-walled seamless steel pipe (wall thickness of around 40-50 mm) actually used for risers and flow lines, the cooling rate at the time of quenching of the pipe becomes slow, particularly at the central portion thereof due to its thickness, and there is the problem that a sufficient strength and toughness cannot be obtained. This is because the cooling rate is slow, and with a conventional alloy design, it is difficult to obtain a uniform microstructure and there is a high probability of a brittle phase developing.

DISCLOSURE OF THE INVENTION

The object of the present invention is to solve the above-described problems, and specifically, its object is to provide a seamless steel pipe for line pipe having high strength and stable toughness and good corrosion resistance particularly in the case of a thick-walled seamless steel pipe as well as a process for the manufacture thereof.

The present inventors analyzed the factors controlling the toughness of a thick-walled, high-strength seamless steel pipe. As a result, they obtained the new findings listed below as (1)-(6), and they found that it is possible to manufacture a seamless steel pipe for line pipe having a high strength of at least X80 grade, high toughness, and good corrosion resistance.

(1) In a thick-walled steel pipe which is finished by quenching and tempering, bainite laths, blocks, and packets which are substructures constituting bainite tend to readily coarsen. Due to its thick wall, the cooling rate during quenching is slow and the transformation from austenite to bainite proceeds slowly, so the bainite laths are coarsened. During subsequent tempering, cementite coarsely precipitates along the prior gamma grain boundaries and along the interfaces of bainite laths, blocks, and packets. Since coarse cementite is brittle, and interface between the cementite and the mother phase are also brittle, the cementite tends to become a path for propagation of cracks, thereby making it difficult to obtain good toughness.

The coarser is cementite, the more the toughness of the pipe decreases. In particular, a variation in Charpy absorbed energy takes place. This is because if coarse cementite is present in the vicinity of the notch of a Charpy test piece, a brittle crack originating at the coarse cementite appears and the brittle fracture propagates. Accordingly, it is necessary to reduce the length of cementite to at most 20 micrometers in order to obtain high toughness and particularly to stabilize Charpy absorbed energy.

(2) The formation of cementite occurs by the mechanism that during bainite transformation caused by quenching from the temperature region in which a single austenitic phase appears, bainite laths, blocks, and packets develop, and at the same time C diffuses so as to be concentrated in untransformed gamma phase. After quenching, the C-enriched portions remain as martensite islands (referred to below as MA: martensite-austenite constituent) at room temperature, and this MA decomposes to form cementite during subsequent tempering. Besides, there are cases in which C diffuses during bainite transformation at the time of quenching and causes coarse cementite to directly precipitate.

Accordingly, in order to refine cementite, it is necessary to refine MA and cementite formed during quenching.

(3) In order to suppress the formation of MA during quenching and refine cementite found after tempering, it is important to decrease the C content and lower the temperature region for transformation from austenite phases to a bainite structure during quenching. Particularly with a thick-walled seamless steel pipe, since there is a limit to the cooling rate, it is necessary to lower the transformation temperature to at most 600° C. in a wide range of cooling rates (e.g., a range in which the average cooling rate between 800° C. and 500° C. is 1-100° C. per second).

In order to lower the transformation temperature, the chemical composition of the steel is selected so that the value of Pcm shown by Equation (1) is at least 0.185:

$$Pcm=[C]+[Si]/30+([Mn]+[Cr]+[Cu])/20+[Mo]/15+[V]/10+5[B] \quad (1)$$

wherein [C], [Si], [Mn], [Cr], [Cu], [Mo], [V] and [B] are numbers respectively indicating the content in mass percent of C, Si, Mn, Cr, Cu, Mo, V and B. When an alloying element shown in the equation is not included in the composition, the term for that alloying element is made 0.

(4) In order to strengthen a thick-walled seamless steel pipe, it is necessary to increase the content of Mo, which is an element effective at increasing resistance to temper softening.

(5) It is necessary to eliminate other factors giving rise to a decrease in toughness in addition to factors causing coarsening of cementite due to coarsening of MA. In a steel in which the Mo content is increased as described above, even if the C content is decreased, if B is added, B segregates at boundaries during quenching. As a result, in the course of quenching, carboborides which are represented in the form of $M_{23}(C,B)_6$ (wherein M stands for an alloying element including primarily Fe, Cr, and Mo) coarsely precipitate along the grain boundaries of an prior gamma phase as a substructure, and these precipitates can also become a cause of a variation in toughness. Accordingly, it is necessary to decrease B as much as possible.

(6) Increasing the Mn content is advantageous for increasing hardenability, but when the Mn content is increased, MnS which decreases toughness tends to easily precipitate. Therefore, Ca is always added to fix S as CaS.

In a seamless steel pipe according to the present invention which can realize a high-strength, thick-walled steel pipe not available in the prior art, the ranges of the contents of the indispensable elements C, Si, Mn, Al, Mo, Ca and N and the unavoidable impurities P, S, O, and B in the chemical composition of the steel is restricted. If necessary, Cr, Ti, Ni, V, Nb and Cu can be added in amounts within prescribed ranges.

The present invention, which is based on the above-described findings, is a seamless steel pipe for line pipe characterized by having a chemical composition which comprises, in mass percent, C: 0.02-0.08%, Si: at most 0.5%, Mn: 1.5-3.0%, Al: 0.001-0.10%, Mo: greater than 0.4% to 1.2%, N: 0.002-0.015%, Ca: 0.0002-0.007%, and a remainder consisting essentially of Fe and impurities, the contents of impurities being at most 0.03% for P, at most 0.005% for S, at most 0.005% for O, and less than 0.0005% for B and the value of Pcm calculated by the following Equation (1) being at least 0.185 and at most 0.250, and having a microstructure which comprises primarily bainite and which has a length of cementite of at most 20 micrometers:

$$Pcm=[C]+[Si]/30+([Mn]+[Cr]+[Cu])/20+[Mo]/15+[V]/10+5[B] \quad (1)$$

wherein [C], [Si], [Mn], [Cr], [Cu], [Mo], [V] and [B] are numbers respectively indicating the content in mass percent of C, Si, Mn, Cr, Cu, Mo, V and B.

The chemical composition may further include one or more elements selected from Cr: at most 1.0%, Ti: at most 0.03%, Ni: at most 2.0%, Nb: at most 0.03%, V: at most 0.2%, and Cu: at most 1.5%.

The present invention also relates to a process for manufacturing a seamless steel pipe for line pipe.

In one mode, a process according to the present invention comprises forming a seamless steel pipe from a steel billet having the above-described chemical composition by heating the billet and subjecting it to hot tube rolling with a starting temperature of 1250-1100° C. and a finishing temperature of at least 900° C., then once cooling the resulting steel pipe, reheating and soaking it at a temperature of at least 900° C. and at most 1000° C., quenching it under conditions such that the average cooling rate from 800° C. to 500° C. at the center of the wall thickness is at least 1° C. per second, and thereafter tempering it at a temperature from 500° C. to less than the $Ac_1$ transformation temperature.

In another mode, a process according to the present invention comprises forming a seamless steel pipe from a steel billet having the above-described chemical composition by heating the billet and subjecting it to hot tube rolling with a starting temperature of 1250-1100° C. and a finishing temperature of at least 900° C., immediately reheating and soaking the resulting steel pipe at a temperature of at least 900° C. and at most 1000° C., then quenching it under conditions such that the average cooling rate from 800° C. to 500° C. at the center of the wall thickness is at least 1° C. per second, and thereafter tempering it at a temperature from 500° C. to less than the $Ac_1$ transformation temperature.

According to the present invention, by prescribing the chemical composition and microstructure of a seamless steel pipe in the above manner, it becomes possible to manufacture a seamless steel pipe for line pipe and particularly a thick-walled seamless steel pipe with a wall thickness of at least 30 mm which has a high strength of X80 grade (a yield strength of at least 551 MPa) and improved toughness and corrosion resistance just by heat treatment for quenching and tempering.

The term "line pipe" used herein means a tubular structure used for transporting fluids such as crude oil and natural gas. It is used not only on land but on the sea and in the sea. A seamless steel pipe according to the present invention is particularly suitable as line pipe used on the sea and in the sea as the above-described flow lines, risers, and the like, but its uses are not restricted thereto.

There are no particular limitations on the shape and dimensions of a seamless steel pipe according to the present invention, but there are restrictions resulting from the manufacturing process of a seamless steel pipe, and normally the outer diameter is a maximum of around 500 mm and a minimum of around 150 mm. The effects of this steel pipe are particularly exhibited with a wall thickness of at least 30 mm, but the wall thicknesses is of course not limited to this value.

A seamless steel pipe according to the present invention can be installed in severe deep seas particularly as a sea bottom flow line. Accordingly, the present invention greatly contributes to stable supply of energy. When it is used as a riser pipe or a flow line installed in deep seas, the wall thickness of the seamless steel pipe is preferably at least 30 mm. There is no particular upper limit on the wall thickness, but normally it is at most 60 mm.

BEST MODE FOR CARRYING OUT THE INVENTION

The present inventors carried out laboratory experiments to investigate about means for increasing the toughness of a thick-walled, high-strength seamless steel pipe. As a result, they found that a deterioration in the toughness and particularly a variation in the toughness of a thick-walled seamless steel pipe results from precipitation of cementite which is itself coarse or forms a coarse aggregate even when individual cementite grains are fine (hereinafter, these two forms of coarse cementite will be referred collectively to as coarse cementite) at the interfaces of bainite laths, blocks, and packets which are substructures constituting bainite which is the primary microstructure of the steel pipe.

Figure 1:
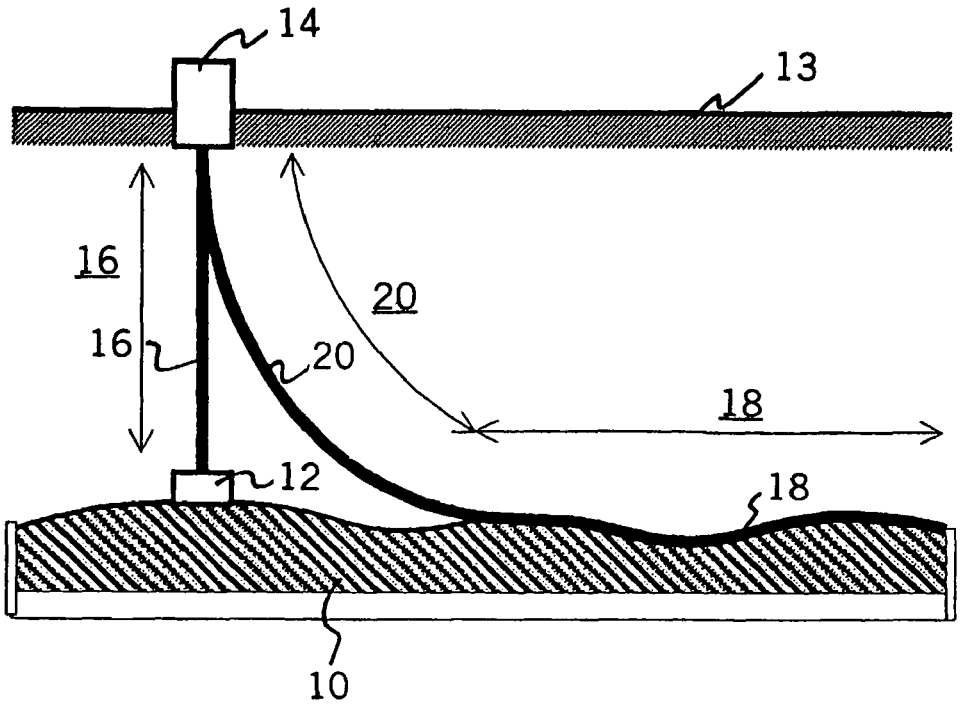
FIG. 1 is an explanatory view schematically showing an arrangement of risers and a flow line in the sea.
Figure 2:
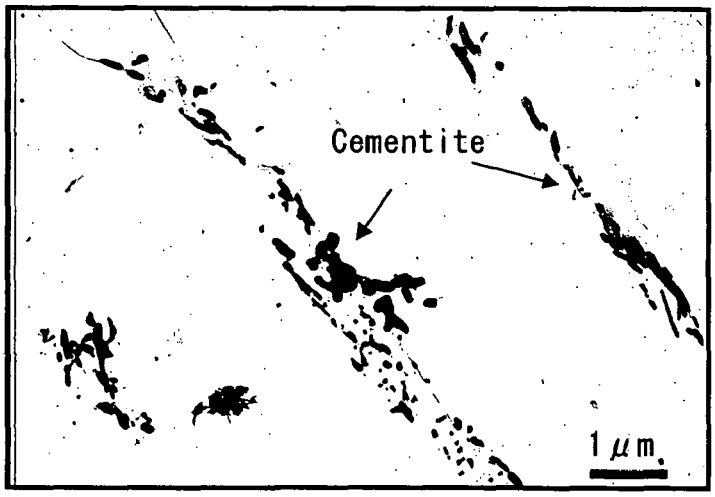
FIG. 2 is an example of a TEM (transmission electron microscope) photograph showing coarse cementite precipitating at the interface of a bainite substructure.

FIG. 2 shows a TEM photograph showing coarse cementite which precipitated at the interface of bainite laths in a replica film taken from a steel which was quenched and then tempered.

Such coarse cementite is formed by decomposition of martensite islands (MA) formed by quenching into cementite due to tempering. There are also situations in which C diffuses during the bainite transformation at the time of quenching and directly precipitates as coarse cementite.

When performing quenching from the state of single austenitic phase, if bainite transformation begins at a high temperature, C readily diffuses, resulting in the formation of coarse MA and hence coarse cementite. On the other hand, if the starting temperature for bainite transformation is low, the diffusion of C is suppressed, and MA and cementite are refined with decreased amounts thereof.

Figure 3:
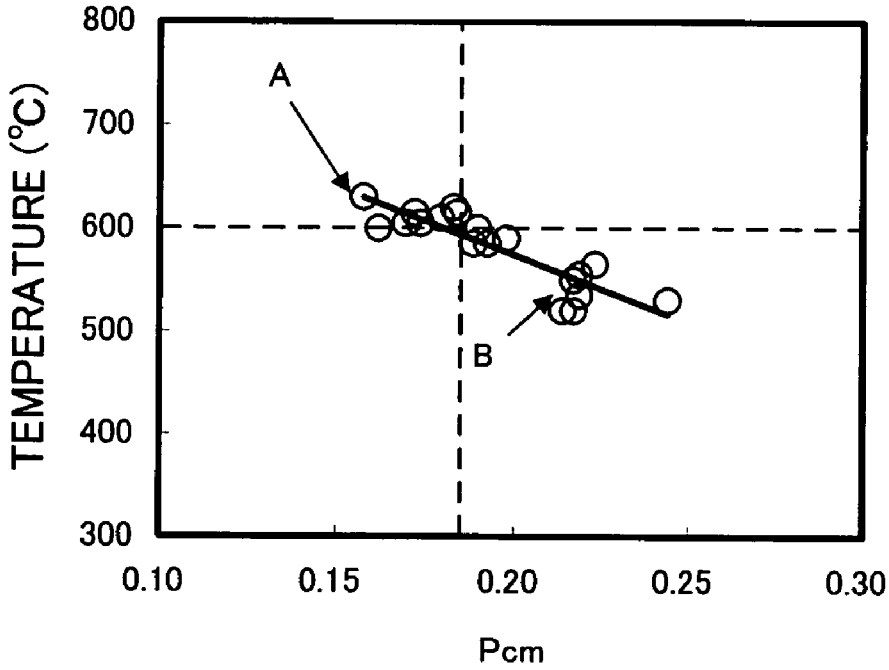
FIG. 3 is a figure showing the relationship between Pcm and the bainite transformation temperature obtained in a Formaster test.

In order to investigate the relationship between the temperature at which bainite transformation begins and the steel composition, measurement of thermal expansion by a Formaster testing instrument was carried out on steels for which Pcm defined by Equation (1) was varied. The test conditions were a gamma transformation or austenizing temperature of 1050° C. and a average cooling rate of 10° C. per second from 800° C. to 500° C. followed by cooling to room temperature. The test results are shown in FIG. 3. It was found that the temperature at which bainite transformation begins could be correlated with Pcm given by the following equation such that the temperature decreased as the value of Pcm increased.

$$Pcm=[C]+[Si]/30+([Mn]+[Cr]+[Cu])/20+[Mo]/15+[V]/10+5[B] \quad (1)$$

(wherein the meaning of each symbol is the same as described above.)

In particular, it was found that almost all of the steels for which Pcm was greater than or equal to 0.185 had a bainite transformation-starting temperature of 600° C. or lower.

Figure 4:
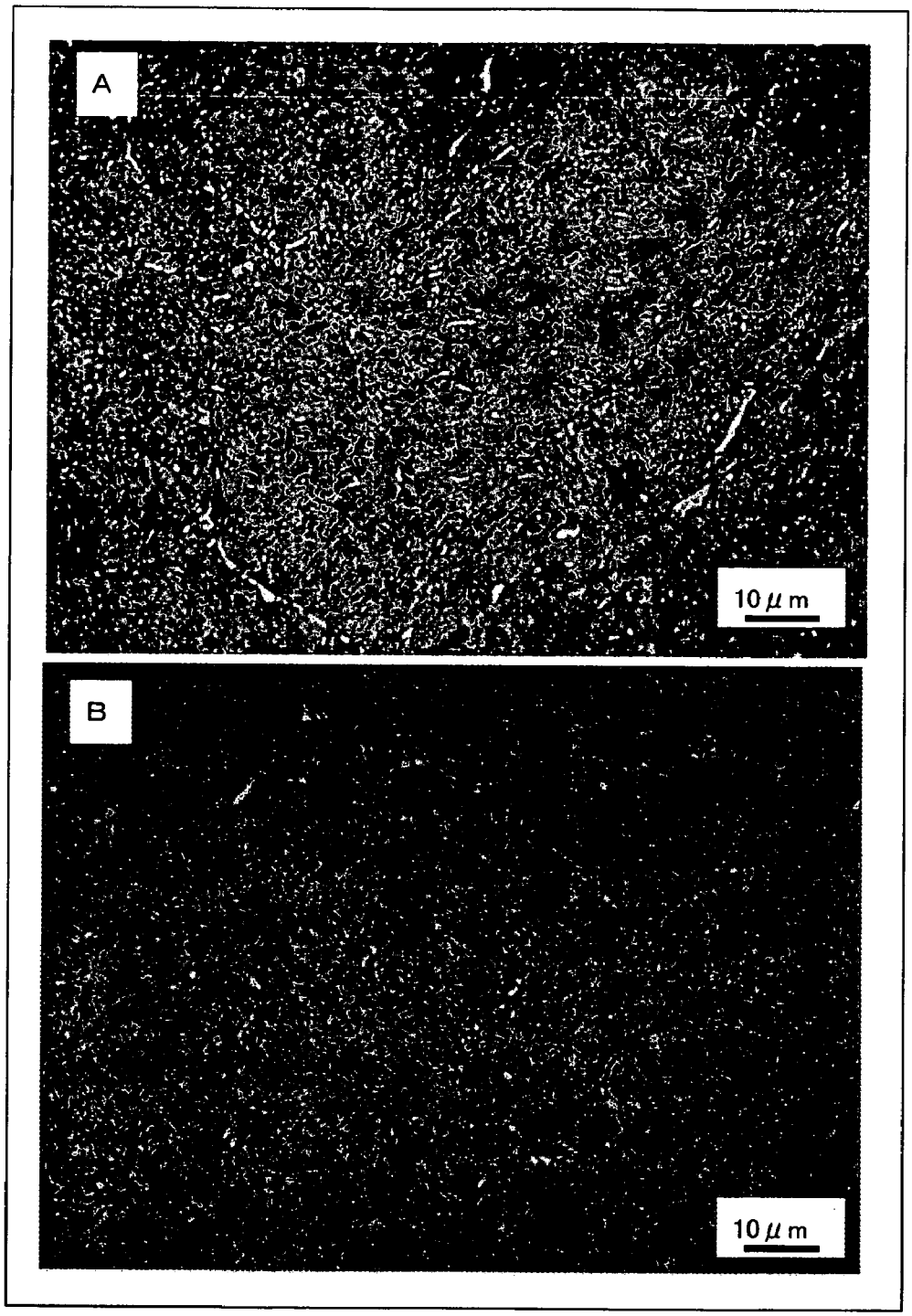
FIG. 4 is an example of a photograph of a microstructure of a test piece which has undergone LePera etching after a Formaster test.

FIG. 4 shows metallographs of the structure of the steels shown as A and B in FIG. 3 obtained by polishing a test piece which had tested as above and causing MA to appear by LePera etching. The white acicular or granular portions in FIG. 4 are MA. Coarse MA was observed in steel A for which the bainite transformation—starting temperature was higher than 600° C. In contrast, coarse MA was not observed in steel B for which the bainite transformation-starting temperature was 600° C. or lower.

From the above results, it can be seen that when Pcm is at least 0.185, even when the average cooling rate from 800° C. to 500° C. during quenching is as low as 10° C. per second, the bainite transformation-starting temperature becomes 600° C. or lower and MA is refined.

In a manufacturing process, it is important to carry out quenching of a steel pipe from the temperature region of single austenitic phase at a high cooling rate. Thus, the period for bainite transformation is shortened during quenching in order to achieve the effects of suppressing the diffusion of C and decreasing MA. A preferred cooling rate is such that the average rate of temperature decrease at the center of the wall thickness of a steel pipe from 800° C. to 500° C. is at least 1° C. per second, preferably at least 10° C. per second, and still more preferably at least 20° C. per second.

In tempering which is carried out subsequent to quenching, it is important to uniformly precipitate cementite in order to increase toughness. Therefore, tempering is carried out in a temperature range of at least 550° C. and at most the $Ac_1$ transformation temperature, and the soaking time in this temperature range is preferably made 5-60 minutes. A preferred lower limit for the tempering temperature is 600° C., and a preferred upper limit is 650° C.

<Chemical Composition of the Steel>

The reasons why the chemical composition of a seamless steel pipe for line pipe according to the present invention is limited as described above are as follows. Percent indicating the content of each element means mass percent.

C: 0.02-0.08%

C is an important element for securing the strength of steel. In order to increase the hardenability of steel and obtain a sufficient strength with a thick-walled material, the C content is made at least 0.02%. On the other hand, if its content exceeds 0.08%, toughness decreases. Therefore, the C content is 0.02-0.08%. From the standpoint of securing the strength of a thick-walled material, a preferred lower limit for the C content is 0.03%, and a more preferred lower limit is 0.04%. A more preferred upper limit for the C content is 0.06%.

Si: at most 0.5%

Since Si functions as a deoxidizing agent in steel making, its addition is necessary, but its content is preferably as small as possible. This is because at the time of circumferential welding for connecting line pipes, Si greatly reduces the toughness of steel in the weld heat affected zone. If the Si content exceeds 0.5%, the toughness of the heat affected zone at the time of large heat input welding markedly decreases. Therefore, the amount of Si added as a deoxidizing agent is at most 0.5%. The Si content is preferably at most 0.3% and more preferably at most 0.15%.

Mn: 1.5-3.0%

It is necessary for Mn to be contained in a large amount in order to obtain the effects of increasing the hardenability of steel such that strengthening occurs up to the center of even a thick-walled material and at the same time increasing the toughness thereof. If the Mn content is less than 1.5%, these effects are not obtained, while if it exceeds 3.0%, the resistance to HIC (hydrogen induced cracking) decreases, so it is made 1.5-3.0%. The lower limit on the Mn content is preferably 1.8%, more preferably 2.0%, and still more preferably 2.1%.

Al: 0.001-0.10%

Al is added as a deoxidizing agent in steel making. In order to obtain this effect, it is added such that its content is at least 0.001%. If the Al content exceeds 0.10%, inclusions in the steel form clusters, thereby deteriorating the toughness of the steel, and at the time of beveling of the ends of a pipe, a large number of surface defects occur. Therefore, the Al content is made 0.001-0.10%. From the standpoint of preventing surface defects, it is preferable to further restrict the upper limit of the Al content, with a preferred upper limit being 0.05% and a more preferred upper limit being 0.03%. A preferred lower limit for the Al content in order to adequately carry out deoxidizing and increase toughness is 0.010%. The Al content in the present invention is expressed as acid soluble Al (so-called "sol. Al").

Mo: greater than 0.4% to 1.2%

Mo has the effect of increasing the hardenability of steel particularly even when the cooling rate is slow, resulting in strengthening up to the center of even a thick-walled material. At the same time, it increases the resistance to temper softening of steel and thus makes it possible to perform high temperature tempering, resulting in an increase in toughness. Therefore, Mo is an important element in the present invention. In order to obtain this effect, it is necessary for the Mo content to exceed 0.4%. A preferred lower limit for the Mo content is 0.5%, and a more preferred lower limit is 0.6%. However, Mo is an expensive element, and its effects saturate at around 1.2%, so the upper limit for the Mo content is 1.2%.

N: 0.002-0.015%

N is included in an amount of at least 0.002% in order to increase the hardenability of steel and obtain a sufficient strength in a thick-walled material. However, if the N content exceeds 0.015%, the toughness of the steel decreases, so the N content is made 0.002-0.015%.

Ca: 0.0002-0.007%

Ca is added aiming at the effects of fixing the impurity S as spherical CaS, thereby improving toughness and corrosion resistance, and suppressing clogging of a nozzle at the time of casting, thereby improving casting properties. In order to obtain these effects, at least 0.0002% of Ca is included. However, if the Ca content exceeds 0.007%, the above-described effects saturate, and not only can a further effect not be exhibited, but it becomes easy for inclusions to form clusters, and toughness and resistance to HIC decrease. Accordingly, the Ca content is made 0.0002-0.007% and preferably 0.0002-0.005%.

A seamless steel pipe for line pipe according to the present invention contains the above-described components and a remainder of Fe and impurities. Of impurities, the contents of P, S, O, and B are restrained to the below-described upper limits.

P: at most 0.03%

P is an impurity element which lowers the toughness of steel, and its content is preferably made as low as possible. If its content exceeds 0.03%, toughness markedly decreases, so the allowable upper limit for P is 0.03%. The P content is preferably at most 0.02% and more preferably at most 0.01%.

S: at most 0.005%

S is also an impurity element which lowers the toughness of steel, and its content is preferably made as low as possible. If its content exceeds 0.005%, toughness markedly decreases, so the allowable upper limit for S is 0.005%. The S content is preferably at most 0.003% and more preferably at most 0.001%.

O (oxygen): at most 0.005%

O is an impurity element which lowers the toughness of steel, and its content is preferably made as small as possible. If its content exceeds 0.005%, toughness markedly decreases, so the allowable upper limit of the O content is 0.005%. The O content is preferably at most 0.003% and more preferably at most 0.002%.

B (impurity): less than 0.0005%

B segregates along austenite grain boundaries during quenching, thereby markedly increasing hardenability, but it causes carboborides in the form of $M_{23}CB_6$ to precipitate during tempering, thereby inducing a variation in toughness. Accordingly, the content of B is preferably made as low as possible. If the content of B is 0.0005% or higher, it produces coarse precipitation of the above-described carboborides, so its content is made less than 0.0005%. A preferred B content is less than 0.0003%.

$0.185<Pcm<0.250$

In addition to the restrictions on the content of each of the above-described elements, the chemical composition of the steel is adjusted such that the value of Pcm expressed by Equation (1) is at least 0.185 and at most 0.250.

$$Pcm=[C]+[Si]/30+([Mn]+[Cr]+[Cu])/20+[Mo]/15+[V]/10+5[B] \quad (1)$$

wherein [C], [Si], [Mn], [Cr], [Cu], [Mo], [V] and [B] are numbers respectively indicating the content in mass percent of C, Si, Mn, Cr, Cu, Mo, V and B. When the steel does not contain a given alloying element, the value of the term for that alloying element is made 0.

As stated above, when the value of Pcm becomes at least 0.185, the bainite transformation temperature decreases and becomes 600° C. or less, and even with a thick-walled seamless steel pipe, the precipitation of coarse cementite found after quenching and tempering is prevented, thereby making it possible to obtain good toughness. On the other hand, if Pcm exceeds 0.250, the strength becomes too high and toughness decreases, and the weldability of line pipe at the time of circumferential welding of line pipes decreases. Accordingly, the content of each element which is plugged into the equation for Pcm is made such that the value of Pcm is at least 0.185 and at most 0.250. A value of Pcm on the higher side within this range gives stable toughness with a higher strength. Therefore, a preferred lower limit for Pcm is 0.210 and a more preferred lower limit is 0.230.

A seamless steel pipe for line pipe according to the present invention can obtain a higher strength, higher toughness, and/or increased corrosion resistance by adding as necessary one or more elements selected from the following to the above-described chemicalt composition.

Cr: at most 1.0%

Cr need not be added, but it may be added in order to increase the hardenability of steel and thus increase the strength of steel in a thick-walled material. However, if its content is too high, it ends up decreasing toughness, so when Cr is added, its content is made at most 1.0%. There is no particular restriction on its lower limit, but the effect of Cr is particularly marked when its content is at least 0.02%. When it is added, a preferred lower limit for the Cr content is 0.1%, and a more preferred lower limit is 0.2%.

Ti: at most 0.03%

Ti need not be added, but it may be added for its effects of preventing surface defects at the time of continuous casting, increasing strength, and refining crystal grains. If the Ti content exceeds 0.03%, toughness decreases, so its upper limit is 0.03%. There is no particular restriction on a lower limit for the Ti content, but in order to obtain the above effects, the Ti content is preferably at least 0.003%.

Ni: at most 2.0%

Ni need not be added, but it may be added for increasing the hardenability of steel and thus increasing the strength of steel in a thick-walled member, and for increasing toughness. However, Ni is an expensive element and its effects saturate if an excess amount thereof is contained. Therefore, when it is added, the upper limit on its content is 2.0%. There is no particular restriction on the lower limit of the Ni content, but its effects are particularly marked when its content is at least 0.02%.

Nb: at most 0.03%

Nb need not be added, but it may be added to provide the effects of increasing strength and refining crystal grains. If the Nb content exceeds 0.03%, toughness decreases, so when it is added, its upper limit is 0.03%. There is no particular lower limit on the Nb content, but in order to obtain its effects, preferably at least 0.003% is added.

V: at most 0.2%

V is an element the content of which is determined by taking the balance between strength and toughness into consideration. When a sufficient strength is is obtained by other alloying elements, not adding V provides better toughness. When V is added as an element for increasing strength, its content is preferably made at least 0.003%. If the V content exceeds 0.2%, toughness greatly decreases, so when it is added, the upper limit on the V content is 0.2%.

Cu: at most 1.5%

Cu need not be added, but it has an effect of improving resistance to HIC, so it may be added with the object of improving resistance to HIC. The minimum Cu content for exhibiting an effect of improving resistance to HIC is 0.02%. Even if Cu is added in excess of 1.5%, its effect saturate, so when it is added, the Cu content is preferably 0.02-1.5%.

<Metallurgical Structure>

In order to improve the balance between strength and toughness, in addition to adjusting the chemical composition of the steel in the above manner, it is necessary for the metallurgical structure to comprise primarily bainite and have a length of cementite therein which is 20 micrometers or less.

In order to obtain a high strength, the metallurgical structure is made comprised primarily of bainite. Cementite precipitates at the interfaces of laths, blocks and packets which are substructures constituting bainite, and at the interfaces of prior gamma grains. This cementite results from martensite islands (MA) formed during quenching by decomposing the martensite into cementite during subsequent tempering or is formed by diffusion of C during the bainite transformation at the time of quenching to cause direct precipitation of cementite, which then grows during tempering.

If this cementite grows until it extends long along the interfaces, it becomes a starting point of a crack or promotes the propagation of a crack, and it can produce a variation in toughness. However, in the case of seamless steel pipe for line pipe, if the length of the above-described cementite is at most 20 micrometers, it is possible to prevent a decrease in toughness due to development or propagation of cracks caused by cementite. The length of cementite is preferably at most 10 micrometers and more preferably at most 5 micrometers.

The length of cementite can be determined by taking five replica films from a steel piece, photographing two fields of view in each replica film under a TEM at a magnification of 3000×, and for each of the total of 10 fields of view which are photographed, measuring the length of the longest cementite, and taking the average value thereof. In TEM observation, the portions which appear to be interfaces of bainite laths, blocks, packets, and prior gamma grain boundaries look like stripes, and by observing these portions, it is easy to find coarse cementite. Cementite breaks down to a certain extent by heat treatment for tempering, but the resulting broken segments are arranged in alignment with each other along the interfaces. When the separation between segments of cementite is at most 0.1 micrometers, they are considered to form a cementite aggregate, and the length of the aggregate is measured as the length of cementite.

<Manufacturing Process>

There are no particular limitations on a manufacturing process for a seamless steel pipe according to the present invention, and usual manufacturing processes can be used. A seamless steel pipe according to the present invention is preferably manufactured by forming a seamless steel pipe by hot rolling such that the wall thickness is preferably at least 30 micrometers and subjecting the resulting steep pipe to quenching and tempering. Below, preferred manufacturing conditions will be described.

Formation of a Seamless Steel Pipe:

Molten steel is prepared so as to have the above-described chemical composition, and it is cast by continuous casting, for example, to produce a casting having a round cross section, which is used as is as a material for rolling (a billet), or it is cast to produce a casting having a rectangular cross section, which is then rolled to form a billet having a round cross section. The resulting billet is formed into a seamless steel pipe by hot tube rolling including piercing, elongation, and sizing.

The tube rolling can be carried out in the same manner as in the manufacture of conventional seamless steel pipes. However, in order to control the shape of inclusions so as to secure hardenability during subsequent heat treatment, pipe forming is preferably carried out under such conditions that the heating temperature at the time of hot piercing (namely, the starting temperature for hot tube rolling) is in the range of 1100-1250° C. and the finishing temperature at the completion of rolling is at least 900° C. If the starting temperature for hot tube rolling is too high, the finishing temperature also becomes too high, and crystal grains coarsen so that the toughness of the product is decreased. On the other hand, if the starting temperature for rolling is too low, an excessive load is applied to equipment at the time of piercing, and the lifespan of the equipment decreases. If the temperature at the completion of rolling is too low, ferrite precipitates during working and causes a variation in properties.

Heat Treatment after Pipe Formation:

The seamless steel pipe manufactured by hot pipe rolling is subjected to quenching and tempering as heat treatment. Quenching may be carried out by either a method in which the steel pipe formed by pipe formation which is still at a high temperature is cooled and then it is reheated and rapidly cooled for quenching, or a method in which quenching is performed immediately after pipe formation in order to utilize the heat of the steel pipe just formed. In either case, quenching is carried out under conditions such that the average cooling rate from 800° C. to 500° C. measured at the central portion of the wall thickness is at least 1° C. per second after reheating and soaking at a temperature of at least 900° C. and at most 1000° C. The subsequent tempering is carried out at a temperature from 500° C. to less than the $Ac_1$ transformation temperature.

When a steel pipe is initially cooled prior to quenching, the temperature at the completion of cooling is not limited. The pipe may be cooled to room temperature and then reheated for quenching, or it may be cooled to around 500° C. where transformation has taken place and then reheated for quenching, or it may be cooled just during transport to a reheating furnace whereupon it is immediately heated in the reheating furnace for quenching. When quenching is carried out immediately after pipe formation, reheating and soaking are carried out in a temperature range of at least 900° C. and at most 1000° C.

If the average cooling rate in the temperature range from 800° C. to 500° C. during quenching is slower than 1° C. per second, an increase in strength cannot be obtained by quenching. In the case of a thick-walled steel pipe having a wall thickness of at least 30 mm, in order to suppress the diffusion of C at the central portion of the wall thickness where cooling is slower and prevent a decrease in toughness due to precipitation of coarse cementite, the average cooling rate is preferably at least 10° C. per second and more preferably at least 20° C. per second.

Tempering is carried out in a temperature ranging from at least 550° C. to at most the $Ac_1$ transformation temperature in order to uniformly precipitate cementite and thus increase the toughness of the pipe. The duration of soaking in this temperature range is preferably 5-60 minutes. In the present invention, since the chemical composition of the steel contains a relatively large amount of Mo, the resistance to temper softening is high enough to make high temperature tempering possible, and an increase in toughness can be achieved thereby. In order to exploit this effect, a preferred range for the tempering temperature is from at least 600° C. to at most 650° C.

In this manner, according to the present invention, a seamless steel pipe for line pipe having a high strength of at least X80 grade and improved toughness and corrosion resistance even with a thick wall can be stably manufactured. The seamless steel pipe can be used for line pipe in deep seas, i.e., as risers and flow lines, so it has great practical effects.

The following examples illustrate the effects of the present invention, but the present invention is not in any way limited thereby.

EXAMPLE 1

150 kg of the steels having the chemical compositions shown in Table 1 (the $Ac_1$ transformation temperatures thereof were all in the range of 700-780° C.) were prepared in a vacuum melting furnace, and the resulting ingots were forged to form blocks having a thickness of 100 mm, which were used as materials for rolling. After each block was heated for soaking for one hour at 1250° C., it was hot rolled to form a steel plate having a plate thickness of 40 mm. The finishing temperature at the completion of rolling was 1000° C.

Before the surface temperature of the resulting hot rolled steel plate could decrease below 900° C., it was placed into an electric furnace at 950° C., and after it was reheated and soaking for 10 minutes in the furnace, it was quenched by water cooling. As a result of separate measurement, the cooling rate at the center of the rolled plate during water cooling was such that the average cooling rate from 800° C. to 500° C. was 10° C. per second. The quenched steel plate was then tempered by soaking for 30 minutes at the temperature shown in Table 2 followed by slow cooling, and the tempered steel plate was used as a test material.

In this example, in order to investigate many compositions of steel, steel plates prepared under the same hot working and heat treatment conditions as employed in the manufacture of a seamless steel pipe were used as test materials to evaluate the mechanical properties and metallurgical structure. The test results were essentially the same as for a seamless steel pipe.

Mechanical Properties:

In order to test for strength, a tensile test was carried out using a JIS No. 12 tensile test piece taken in the T-direction to the rolling direction of the plate from the central portion of the thickness of each test steel plate to measure the tensile strength (TS) and the yield strength (YS). The tensile test was carried out in accordance with JIS Z 2241.

Toughness was evaluated as the minimum value of the absorbed impact energy measured in a Charpy impact test at −40° C. which was carried out using ten test pieces measuring 10 mm wide by 10 mm thick and having a V-notch with a depth of 2 mm corresponding to a JIS Z 2202 No. 4 test piece which were taken in the T-direction to the rolling direction of the plate from the central portion of the thickness of each test steel plate.

The strength was considered acceptable when YS was at least 552 MPa (the lower limit of the yield strength of X80 grade), and the toughness was acceptable when the Charpy absorbed energy at −40° C. was at least 100 J.

Metallurgical Structure:

Five replica films were taken from each test steel plate at the center of the thickness, two fields of view of each replica were photographed with a TEM at a magnification of 3000×, and the maximum length of cementite which precipitated at the interfaces in each field of view was measured. The measurement conditions at this time were as described above. The average value of the ten values of cementite length obtained in this manner was made the cementite length.

Table 2 shows test results for YS, TS, the minimum value of the absorbed energy in the Charpy test at −40° C., and the cementite length for each test material along with the heat treatment conditions after hot rolling.

TABLE 1

| Steel | Chemical composition of steels (mass %; balance: Fe) | | | | | | | | | | | | | | | | | |
|---|---|---|---|---|---|---|---|---|---|---|---|---|---|---|---|---|---|---|
| No. | C | Si | Mn | P | S | Mo | Ca | sol.Al | O | N | Ti | Cr | Ni | Cu | V | Nb | B | Pcm |
| 1 | 0.048 | 0.09 | 1.80 | 0.006 | 0.001 | 0.49 | 0.0009 | 0.01 | 0.002 | 0.0056 | 0.006 | 0.30 | | | | | <0.0001 | 0.189 |
| 2 | 0.051 | 0.08 | 2.04 | 0.007 | 0.001 | 0.50 | 0.0005 | 0.01 | 0.003 | 0.0057 | 0.006 | 0.31 | 0.2 | | | | <0.0001 | 0.208 |
| 3 | 0.050 | 0.09 | 2.04 | 0.007 | 0.001 | 0.50 | 0.0009 | 0.012 | 0.003 | 0.0055 | 0.007 | 0.31 | 0.39 | | | | <0.0001 | 0.210 |
| 4 | 0.049 | 0.07 | 2.01 | 0.008 | 0.001 | 0.51 | 0.0003 | 0.014 | 0.003 | 0.0055 | 0.006 | 0.50 | | | | | <0.0001 | 0.211 |
| 5 | 0.050 | 0.09 | 2.01 | 0.008 | 0.001 | 0.51 | 0.0014 | 0.025 | 0.001 | 0.0055 | 0.010 | 0.31 | 0.83 | 0.2 | | | <0.0001 | 0.227 |
| 6 | 0.048 | 0.09 | 2.04 | 0.007 | 0.001 | 0.52 | 0.0014 | 0.028 | 0.002 | 0.0055 | 0.010 | 0.31 | 1.59 | | | | <0.0001 | 0.230 |
| 7 | 0.051 | 0.10 | 2.03 | 0.009 | 0.001 | 0.52 | 0.0009 | 0.023 | 0.001 | 0.0056 | 0.007 | 0.32 | | | 0.05 | | <0.0001 | 0.212 |
| 8 | 0.038 | 0.10 | 2.01 | 0.013 | 0.001 | 0.68 | 0.0008 | 0.022 | 0.001 | 0.0083 | 0.007 | 0.32 | | | | 0.003 | <0.0001 | 0.203 |
| 9 | 0.049 | 0.09 | 2.03 | 0.011 | 0.001 | 0.70 | 0.001 | 0.023 | 0.001 | 0.0057 | 0.008 | 0.32 | | | | 0.028 | <0.0001 | 0.216 |
| 11 | 0.048 | 0.10 | 1.99 | 0.009 | 0.001 | 0.72 | 0.0012 | 0.02 | 0.002 | 0.0052 | 0.011 | 0.30 | | | | | <0.0001 | 0.214 |
| 12 | 0.049 | 0.09 | 2.69 | 0.010 | 0.001 | 0.54 | 0.0013 | 0.025 | 0.002 | 0.0051 | 0.011 | 0.21 | | | | | <0.0001 | 0.233 |
| 13 | 0.060 | 0.09 | 2.03 | 0.009 | 0.001 | 0.72 | 0.0014 | 0.03 | 0.001 | 0.0049 | 0.010 | 0.31 | | | | | <0.0001 | 0.228 |
| 14 | 0.069 | 0.28 | 2.03 | 0.009 | 0.001 | 0.73 | 0.0016 | 0.03 | 0.001 | 0.0058 | 0.010 | 0.31 | | | | | <0.0001 | 0.244 |
| 15 | 0.049 | 0.28 | 2.01 | 0.007 | 0.001 | 0.74 | 0.0013 | 0.03 | 0.001 | 0.0054 | 0.010 | 0.30 | | | | | <0.0001 | 0.223 |
| 16 | 0.048 | 0.09 | 2.01 | 0.009 | 0.001 | 0.82 | 0.0014 | 0.027 | 0.001 | 0.0051 | 0.010 | 0.31 | | | | | <0.0001 | 0.222 |
| 17 | 0.048 | 0.09 | 2.41 | 0.010 | 0.001 | 0.75 | 0.0014 | 0.026 | 0.002 | 0.005 | 0.011 | 0.12 | | | | | <0.0001 | 0.228 |
| 18 | 0.050 | 0.09 | 2.70 | 0.011 | 0.001 | 0.76 | 0.0012 | 0.024 | 0.002 | 0.0053 | 0.011 | | | | | | <0.0001 | 0.239 |
| 19 | 0.036 | 0.09 | 2.88 | 0.011 | 0.001 | 0.74 | 0.0013 | 0.024 | 0.002 | 0.0047 | 0.011 | | | | | | <0.0001 | 0.232 |
| 20 | 0.060 | 0.29 | 1.55 | 0.011 | 0.001 | 0.41 | 0.0020 | 0.030 | 0.002 | 0.0056 | 0.010 | | | | 0.05 | | <0.0001 | 0.180 |
| 21 | 0.069 | 0.29 | 1.41 | 0.011 | 0.001 | 0.29 | 0.0023 | 0.031 | 0.002 | 0.0062 | 0.010 | 0.31 | 0.39 | 0.4 | 0.05 | | <0.0001 | 0.215 |
| 22 | 0.049 | 0.09 | 1.62 | 0.008 | 0.001 | 0.41 | 0.0013 | 0.024 | 0.003 | 0.0049 | 0.009 | 0.50 | | | 0.05 | | 0.0006 | 0.193 |
| 23 | 0.048 | 0.09 | 2.03 | 0.050 | 0.001 | 0.51 | 0.001 | 0.026 | 0.001 | 0.0054 | 0.010 | 0.31 | | | | | <0.0001 | 0.202 |
| 24 | 0.047 | 0.09 | 2.05 | 0.007 | 0.002 | 0.73 | <0.001 | 0.028 | 0.001 | 0.0053 | 0.010 | 0.31 | | | | | <0.0001 | 0.217 |
| 25 | 0.049 | 0.08 | 2.04 | 0.007 | 0.001 | 0.50 | 0.0008 | <0.001 | 0.004 | 0.0056 | 0.004 | 0.31 | | | | | <0.0001 | 0.203 |

TABLE 2

| Steel No. | Finishing temp. of rolling (° C.) | Cooling temp. after rolling (° C.) | Reheating temperature (° C.) | Tempering temperature (° C.) | Length of cementite at interfaces (μm) | YS (MPa) | TS (MPa) | Minimum value of vE-40° C. (J) |
|---|---|---|---|---|---|---|---|---|
| 1 | 1000 | 900 | 950 | 600 | 16 | 564 | 644 | 126 |
| 2 | 1000 | 900 | 950 | 600 | 15 | 557 | 635 | 150 |
| 3 | 1000 | 900 | 950 | 600 | 10 | 593 | 672 | 166 |
| 4 | 1000 | 900 | 950 | 550 | 12 | 623 | 716 | 120 |
| 5 | 1000 | 900 | 950 | 620 | 8 | 596 | 687 | 241 |
| 6 | 1000 | 900 | 950 | 620 | 6 | 637 | 717 | 259 |
| 7 | 1000 | 900 | 950 | 650 | 7 | 619 | 699 | 100 |
| 8 | 1000 | 900 | 950 | 620 | 10 | 585 | 664 | 250 |
| 9 | 1000 | 900 | 950 | 600 | 10 | 622 | 716 | 215 |
| 11 | 1000 | 900 | 950 | 620 | 10 | 610 | 699 | 179 |
| 12 | 1000 | 900 | 950 | 560 | 7 | 610 | 688 | 174 |
| 13 | 1000 | 900 | 950 | 620 | 8 | 650 | 733 | 184 |
| 14 | 1000 | 900 | 950 | 620 | 10 | 643 | 726 | 148 |
| 15 | 1000 | 900 | 950 | 620 | 5 | 623 | 711 | 234 |
| 16 | 1000 | 900 | 950 | 620 | 5 | 595 | 682 | 248 |
| 17 | 1000 | 900 | 950 | 600 | 10 | 593 | 681 | 151 |
| 18 | 1000 | 900 | 950 | 600 | 8 | 626 | 706 | 142 |
| 19 | 1000 | 900 | 950 | 600 | 5 | 601 | 680 | 176 |
| 20 | 1000 | 900 | 950 | 650 | 25 | 565 | 643 | 58 |
| 21 | 1000 | 900 | 950 | 550 | 10 | 564 | 660 | 90 |
| 22 | 1000 | 900 | 950 | 650 | 23 (carboborides) | 586 | 655 | 95 |
| 23 | 1000 | 900 | 950 | 620 | 10 | 567 | 659 | 15 |
| 24 | 1000 | 900 | 950 | 620 | 15 | 575 | 664 | 16 |
| 25 | 1000 | 900 | 950 | 600 | 15 | 585 | 674 | 5 |

Steels Nos. 1-19 are examples which satisfy the chemical composition and manufacturing conditions prescribed by the present invention. In each of these examples, cementite was fine with a length of at most 20 micrometers, and good toughness was obtained.

In contrast, Steels Nos. 20-25 were comparative examples for which the chemical composition was outside the range of the present invention, and each of these had a low toughness.

More specifically, Steel No. 20 had a value of Pcm which was smaller than 0.185, so the cementite which precipitated at interfaces became coarse. This produced a marked variation of Charpy absorbed energy, and the minimum value greatly decreased. Steel No. 21 had contents of Mn and Mo which were smaller than the prescribed ranges, so its toughness decreased. Steel No. 22 had too high a B content, so $M_{23}(C, B)_6$-type carboborides coarsely precipitated and produced a variation in absorbed energy so that the minimum value decreased. Steel No. 23 had too high a content of P, so toughness decreased. Steel No. 24 did not contain Ca, so MnS coarsely precipitated, and this produced a variation in the absorbed energy. Steel No. 25 had too small an Al content, so coarse oxide inclusions were formed and produced a variation in the absorbed energy.

EXAMPLE 2

This example illustrates the manufacture of a seamless steel pipe with actual equipment.

A steel having the chemical compositions shown in Table 3 was prepared by melting, and a round billet to be subject to rolling was manufactured with a continuous casting machine. The round billet was subjected to heat treatment by soaking at 1250° C. for one hour and then worked by a piercer having skewed rolls to form a pierced blank. The pierced blank was then subjected to finish rolling using a mandrel mill and a sizer, and a seamless steel pipe with an outer diameter of 219.4 mm and a wall thickness of 40 mm was obtained. The finishing temperature at the completion of the hot tube rolling, the cooling temperature after rolling, and the reheating temperature were as shown in Table 4.

After the completion of rolling, the steel pipe was placed into a reheating furnace before its surface temperature fell below 900° C., and after soaking in the furnace at 950° C., it was quenched by water cooling such that the average cooling rate from 800° C. to 500° C. at the central portion of the thickness was 10° C. per second. Thereafter, it was tempered by soaking for 10 minutes at a temperature of 600° C., which was lower than the $Ac_1$ transformation temperature, followed by slow cooling to obtain test steel pipe A.

Separately, a seamless steel pipe which was prepared by hot tube rolling in the same manner as described above was air cooled after the completion of rolling until the surface temperature of the steel pipes was room temperature. Thereafter, the steel pipe was placed into a reheating furnace and soaked there at 950° C. and then quenched by water cooling such that the cooling rate from 800° C. to 500° C. at the center of the thickness was 3° C. per second. It was then tempered under the same conditions as described above to obtain test steel pipe B.

The cooling rate during quenching was adjusted by varying the flow rate of cooling water.

The strength and toughness and cementite length of the resulting test steel pipes A and B were measured in the following manner. The test results are shown in Table 4 together with the heating conditions after hot pipe forming.

The strength was evaluated by measuring the yield strength (YS) in a tensile test in accordance with JIS Z 2241 using a JIS No. 12 tensile test piece taken from each test steel pipe.

For toughness, a Charpy test was carried out using ten impact test pieces measuring 10 mm wide by 10 mm thick with a V-shaped notch having a depth of 2 mm which were taken in the lengthwise direction from the center of the thickness of each test steel pipe and which corresponded to a JIS Z 2202 No. 4 test piece. Toughness was evaluated by finding the minimum value of the absorbed energy.

The length of cementite which precipitated along the interfaces was determined by taking a replica film from the center of the thickness of each test steel pipe and measuring the length of cementite by the same manner as in Example 1.

TABLE 3

| | C | Si | Mn | P | S | Mo | Ca | sol. Al | O | N | Ti | Cr | Ni | Cu | V | Nb | B | Pcm |
|---|---|---|---|---|---|---|---|---|---|---|---|---|---|---|---|---|---|---|
| Steel No. 26 | 0.040 | 0.27 | 2.06 | 0.006 | 0.0012 | 0.74 | 0.0016 | 0.033 | 0.002 | 0.0047 | 0.009 | 0.3 | 0.02 | 0.02 | | | | 0.218 |

TABLE 4

| Finishng temp. of rolling (° C.) | Cooling temp. after rolling (° C.) | Reheating temp. (° C.) | Cooling rate during quenching (° C./s) | Tempering temp. (° C.) | Length of cementite at interfaces (μm) | YS (MPa) | TS (MPa) | Minimum value of vE-40° C. (J) |
|---|---|---|---|---|---|---|---|---|
| 1000 | 900 | 950 | 10° C./sec | 600 | 8 | 625 | 734 | 240 |
| 950 | Room temp. | 950 | 3° C./sec | 600 | 5 | 647 | 729 | 230 |

As is clear from the results shown in Table 4, according to the present invention, a seamless steel pipe can be obtained which has a high strength of at least X80 grade of API standards and which at the same time has good toughness in spite of being a thick-walled steel pipe.

The invention claimed is:

1. A seamless steel pipe for line pipe characterized by having a chemical composition consisting essentially of, in mass percent, C: 0.02-0.08%, Si: at most 0.5%, Mn: 1.8-3.0%, Al: 0.001-0.10%, Mo: greater than 0.4% to 1.2%, N: 0.002-0.015%, Ca: 0.0002-0.007%, Cr: 0-1.0%, Ti: 0-0.03%, Ni: 0-2.0%, Nb: 0-0.03%, V: 0-0.2%, Cu: 0-1.5%, and a remainder of Fe and impurities, wherein the contents of the impurities are at most 0.03% for P, at most 0.005% for S , at most 0.005% for O, and less than 0.0005% for B, and wherein the value of Pcm calculated by the following Equation (1) is at least 0.185 and at most 0.250, the pipe having a microstructure primarily comprising bainite and having a length of cementite of at most 20 micrometers:

$$Pcm=[C]+[Si]/30+([Mn]+[Cr]+[Cu])/20+[Mo]/15+[V]/10+5[B] \quad (1)$$

wherein [C], [Si], [Mn], [Cr], [Cu], [Mo], [V], and [B] are numbers respectively indicating the content in mass percent of C, Si, Mn, Cr, Cu, Mo, V, and B and further wherein the pipe has a toughness of 100 J or more which is evaluated as the minimum value of the absorbed energy impact measured in a Charpy impact test at −40 ° Cm using a test piece measuring 10 mm wide and 10 mm thick and having a V-notch with a depth of 2 mm.

2. A seamless steel pipe for line pipe as set forth in claim 1 wherein the chemical composition contains, in mass percent, one or more elements selected from the group consisting of Cr: 0.02-1.0%, Ti: 0.003-0.03%, Ni: 0.02-2.0%, Nb: 0.003-0.03%, V: 0.003-0.2%, and Cu: 0.02-1.5%.

3. A process of manufacturing a seamless steel pipe for line pipe characterized by heating a steel billet having a chemical composition consisting essentially of, in mass percent, C:

0.02-0.08%, Si: at most 0.5%, Mn: 1.8-3.0%, Al: 0.001-0.10%, Mo: greater than 0.4% to 1.2%, N: 0.002-0.015%, Ca: 0.0002-0.007%, Cr: 0-1.0%, Ti: 0-0.03%, Ni: 0-2.0%, Nb: 0-0.03%, V: 0-0.2%, Cu: 0-1.5%, and a remainder of Fe and impurities, wherein the contents of the impurities are at most 0.03% for P, at most 0.005% for S, at most 0.005% for 0, and less than 0.0005% for B, and wherein the value of Pcm calculated by the following Equation (1) is at least 0.185 and at most 0.250, the pipe having a microstructure primarily comprising bainite and having a length of cementite of at most 20 micrometers $$Pcm = [C] + [Si]/30 + ([Mn]+[Cr]+[Cu])/20 + [Mo]/15 + [V]/10 + 5[B] \quad (1)$$

wherein [C], [Si], [Mn], [Cr], [Cu], [Mo], [V], and [B] are numbers respectively indicating the content in mass percent of C, Si, Mn, Cr, Cu, Mo, V, and B, forming the billet into a seamless steel pipe by hot tube rolling with a starting temperature of 1250-1100° C. and a finishing temperature of at least 900° C., reheating for soaking the resulting steel pipe at a temperature of at least 900° C. and at most 1000° C., quenching the pipe under conditions such that the average cooling rate from 800° C. to 500° C. at the center of the wall thickness is at least 1° C. per second, and then tempering the quenched pipe at a temperature of from 500° C. to less than the $Ac_1$ transformation temperature, wherein the pipe has a toughness of 100 J or more which is evaluated as the minimum value of the absorbed energy impact measured in a Charpy impact test at −40 ° Cm using a test piece measuring 10 mm wide and 10 mm thick and having a V-notch with a depth of 2 mm.

4. A process as set forth in claim 3 wherein the seamless steel pipe which is formed by hot tube rolling is initially cooled before quenching.

5. A process as set forth in claim 3 wherein the seamless steel pipe which is formed by hot tube rolling is immediately quenched.

6. A process as set forth in claim 3, wherein the chemical composition contains, in mass percent, one or more elements selected from the group consisting of Cr: 0.02-1.0%, Ti' 0.003-0.03%, Ni: 0.02-2.0%, Nb: 0.003-0.03%, V: 0.003-0.2%, and Cu" 0.02-1.5%.

* * * * *